US011111107B2

(12) United States Patent
Duijnstee et al.

(10) Patent No.: US 11,111,107 B2
(45) Date of Patent: Sep. 7, 2021

(54) DRIVE UNIT

(71) Applicant: PLATINUM STAIRLIFTS LTD., Cross Hills (GB)

(72) Inventors: Eduard Duijnstee, Ouderkerk aan den Ijssel (NL); Gavin Hancock, Durham (GB); Michael Rees, Cross Hills (GB)

(73) Assignee: Platinum Stairlifts Ltd.

( * ) Notice: Subject to any disclaimer, the term of this patent is extended or adjusted under 35 U.S.C. 154(b) by 335 days.

(21) Appl. No.: 16/313,688

(22) PCT Filed: May 19, 2017

(86) PCT No.: PCT/GB2017/051415
§ 371 (c)(1),
(2) Date: Dec. 27, 2018

(87) PCT Pub. No.: WO2018/002573
PCT Pub. Date: Jan. 4, 2018

(65) Prior Publication Data

US 2019/0225460 A1 Jul. 25, 2019

(30) Foreign Application Priority Data

Jun. 30, 2016 (GB) ..... 1611478

(51) Int. Cl.
*B66B 9/08* (2006.01)
*B66B 19/00* (2006.01)

(52) U.S. Cl.
CPC ..... *B66B 9/0815* (2013.01); *B66B 9/08* (2013.01); *B66B 9/0838* (2013.01); *B66B 19/00* (2013.01)

(58) Field of Classification Search
CPC ... B66B 9/0815; B66B 9/0807; B66B 9/0846; B66B 9/0853; B66B 19/00; B66B 9/08; B66B 9/0838; F16H 55/26; A61G 7/10
See application file for complete search history.

(56) References Cited

U.S. PATENT DOCUMENTS 8,607,936 B2 * 12/2013 Szentistvany ..... B66B 9/0807 187/201
10,843,901 B2 * 11/2020 Hoedjes ..... B66B 9/0815
2004/0104078 A1 * 6/2004 Szentistvany ..... B66B 9/0846 187/201

(Continued)

FOREIGN PATENT DOCUMENTS

EP 1359141 11/2003
EP 1449801 A1 8/2004

(Continued)

OTHER PUBLICATIONS

Intellectual Property Office Search Report dated Dec. 13, 2016; Application No. GB1611478.7.

(Continued)

*Primary Examiner* — Mark T Le
(74) *Attorney, Agent, or Firm* — Vorys, Sater, Seymour and Pease LLP; Scott M. Guttman

(57) ABSTRACT

A drive unit for a rail-guided displacement device comprising: a base part; a housing comprising: a first yoke shaft sleeve and a second yoke shaft sleeve, the first yoke shaft sleeve and the second yoke shaft sleeve being spaced apart and disposed on opposite sides of the base part, and a cross sleeve rigidly connecting the first yoke shaft sleeve and the second yoke shaft sleeve; wherein the housing is pivotally connected to the base part such that the housing can pivot, in use, relative to the base part about a pivot axis; a first yoke and a second yoke, each of the first yoke and the second yoke comprising: a guide wheel assembly, the guide wheel assembly comprising one or more guide wheels arranged to roll, in use, along a running rail; and a yoke shaft; wherein the yoke shaft of the first yoke is received in the first yoke sleeve and the yoke shaft of the second yoke is received in the second yoke sleeve, the yoke shafts being movable longitudinally within their respective yoke sleeve, in use; and a mirror shaft disposed at least partially within the cross sleeve, the mirror shaft providing communication between (Continued)

the yoke shafts in the yoke sleeves and being configured such that when, in use, one of the yoke shafts moves longitudinally in its yoke sleeve the mirror shaft causes the other of the yoke shafts correspondingly to move longitudinally in its yoke sleeve.

26 Claims, 5 Drawing Sheets

(56) References Cited

U.S. PATENT DOCUMENTS

| | | | | |
|---|---|---|---|---|
| 2008/0271953 | A1* | 11/2008 | Vroegindeweij | ..... B66B 9/0838 187/245 |
| 2011/0024237 | A1* | 2/2011 | Vroegindeweij | ..... B66B 9/0838 187/201 |
| 2014/0083801 | A1* | 3/2014 | Vroegindeweij | ..... B66B 9/08 187/201 |

FOREIGN PATENT DOCUMENTS

| | | | |
|---|---|---|---|
| GB | 2368574 | A | 8/2002 |
| GB | 2527410 | A | 12/2015 |
| JP | 1077173 | | 3/1998 |
| JP | 1077176 | A | 3/1998 |
| WO | 9712830 | A1 | 4/1997 |
| WO | 9837007 | A1 | 8/1998 |
| WO | 2005087644 | A2 | 9/2005 |
| WO | 2014098575 | A1 | 6/2014 |

OTHER PUBLICATIONS

International Search Report and Written Opinion dated 7 Sep. 1, 2017. International Application No. PCT/GB2017/051415, Filing Date: May 19, 2017. Applicant: Platinum Stairlifts Ltd. Authorized Officer: Jurre Blouw.

* cited by examiner

Side view

Plan view

DRIVE UNIT

This application is a National Stage of International Application No. PCT/GB2017/051415, filed May 19, 2017, which is incorporated by reference herein in its entirety.

FIELD OF INVENTION

The present invention relates to a drive unit for a rail-guided displacement device, such as, but not exclusively, a stair lift.

BACKGROUND

Stair lifts have been used for several years, in order to transport people who have difficulty negotiating staircases from one floor to another. Stair lifts generally comprise a rail arrangement which runs along a staircase in a similar manner to a bannister. The rail arrangement may comprise a single rail or a plurality of rails. Stair lifts further comprise a drive unit, which runs along the rail(s) and which supports a load-bearing means typically comprising a support platform such as a seat.

In many instances, the stair lift will travel along a rail or rails comprising straight sections and/or curved sections of variable gradients. The combination of straight rail sections, curved rail sections and variations in gradient will depend upon the shape and dimensions of the staircase. For instance, a staircase may comprise two or more flights, often of different gradients and frequently with horizontal rail sections as corners are turned and level floor sections are negotiated.

The rail arrangement may comprise at least one of the following types of bend: climbing bends, in which the gradient of the rail arrangement changes; flat bends, in which the direction of the rail arrangement changes and the gradient does not change; and bends that are a mixture of a climbing bend and a flat bend, i.e. where the gradient and the direction of the rail arrangement change.

It would be desirable for the stair lift to be capable of negotiating smoothly and reliably a rail arrangement comprising any combination of types of bend.

WO97/12830 discloses a running gear for a drive mechanism for a rail-guided displacement device, such as a stair lift. The running gear comprises a base part, drive means and at least two sets of guide wheels, arranged behind each other, viewed in direction of travel of the running gear, so that, during use, the running gear is guided along the rail in a desired position by the guide wheels, characterised in that the base part comprises at least a bridge piece, a first and a second frame part, the frame parts each being connected to the bridge piece so as to be movable about at least one swivel axis, each frame part carrying a set of guide wheels and the frame parts being mutually coupled by coupling means which form a mechanical mirror, so that the movements of the first and the second part are always each other's mirror image in a first plane of symmetry extending at right angles to the driving direction of the running gear between the first and the second frame part, and viewed relative to the bridge piece.

SUMMARY

A first aspect of the invention provides a drive unit for a rail-guided displacement device comprising:

a base part;

a housing comprising:

a first yoke shaft sleeve and a second yoke shaft sleeve, the first yoke shaft sleeve and the second yoke shaft sleeve being spaced apart and disposed on opposite sides of the base part, and a cross sleeve rigidly connecting the first yoke shaft sleeve and the second yoke shaft sleeve; wherein the housing is pivotally connected to the base part such that the housing can pivot, in use, relative to the base part about a pivot axis;

a first yoke and a second yoke, each of the first yoke and the second yoke comprising:

a guide wheel assembly, the guide wheel assembly comprising one or more guide wheels arranged to roll, in use, along a running rail; and a yoke shaft;

wherein the yoke shaft of the first yoke is received in the first yoke sleeve and the yoke shaft of the second yoke is received in the second yoke sleeve, the yoke shafts being movable longitudinally within their respective yoke sleeve, in use; and a communication means disposed at least partially within the cross sleeve, the communication means providing communication between the yoke shafts in the yoke sleeves and being configured such that when, in use, one of the yoke shafts moves longitudinally in its yoke sleeve the communication means causes the other of the yoke shafts correspondingly to move longitudinally in its yoke sleeve.

Advantageously, the drive unit may be able to negotiate rails comprising all types of bends, due to the combination of pivotal movement of the housing relative to the base part, which results in a swing of the yoke shaft sleeves, and the longitudinal movements of the yoke shafts within their respective yoke sleeves, which longitudinal movements correspond with one another due to the communication means providing communication between the yoke shafts.

In effect, the drive unit provides a mirror, e.g. an at least partially mechanical mirror, whereby, in use, movements of the first yoke shaft and the second yoke shaft are each other's mirror image in a plane of symmetry. This plane of symmetry is in a plane lying between the first yoke shaft sleeve and the second yoke shaft sleeve. The plane of symmetry is positioned at right angles to the driving direction of the drive unit, i.e. the direction of movement of the drive unit at the location of the plane of symmetry extends at least substantially as a normal to the relevant plane of symmetry.

Advantageously, the guide wheels of the first yoke can move relative to the guide wheels of the second yoke such that the plane in which the axes of the respective guide wheels are located always intersects the rail(s) at right angles. Thus, each guide wheel can continuously be held in such a position relative to the rail(s) that the tread thereof is located parallel to a tangent to the relevant part of a curve, so that when the curve is being traversed, each guide wheel can move through that curve while rolling in an optimum manner. As a result of each movement of one yoke being mirrored relative to the other yoke, when, for instance, a curve is run into or negotiated, the position of the leading yoke is adjusted by the leading guide wheels, so that the guide wheels may follow an ideal line. The position of the following yoke also correspondingly adjusts to the curve being negotiated and consequently the guide wheels of the following yoke may follow the ideal line.

In an embodiment, the communication means may comprise a mechanical mirror shaft configured to engage with the yoke shafts. For instance, the mechanical mirror shaft may engage with the yoke shafts such that longitudinal movement of the yoke shafts within the yoke shaft sleeves causes rotational movement of the mechanical mirror shaft. The mechanical mirror shaft may rotate, in use, about the longitudinal axis of the cross sleeve.

The mechanical mirror shaft may comprise gears at or near its ends and the yoke shafts may each comprise toothed portions, the gear at or near each end of the mechanical mirror shaft being in engagement with the toothed portion of one of the yoke shafts.

In an embodiment, the pivot axis may be offset from the longitudinal axis of the cross sleeve.

In an embodiment, the yoke shafts may be parallel with each other. Central longitudinal axes of the yoke shafts may be parallel with each other and may extend substantially perpendicularly to a plane containing the pivot axis and the longitudinal axis of the cross sleeve. Typically, the central longitudinal axes of the yoke shafts may intersect a plane containing the pivot axis and the longitudinal axis of the cross sleeve. In embodiments, in which the pivot axis is offset from the longitudinal axis of the cross sleeve, the central longitudinal axes of the yoke shafts may intersect the plane containing the pivot axis and the longitudinal axis of the cross sleeve between the pivot axis and the longitudinal axis of the cross sleeve.

In an embodiment, the guide wheel assemblies may each comprise a plurality of guide wheels.

In an embodiment, each guide wheel assembly may be pivotable relative to the yoke, e.g. such that the guide wheel assemblies may each remain, in use, perpendicular to the running rail being traversed by the drive unit.

In an embodiment, each yoke may comprise an open jaw having the guide wheel assembly mounted therein. The guide wheel assembly may be pivotally mounted in the open jaw.

The yoke shaft may extend in an outward direction from the open jaw.

The drive unit may comprise at least one sensor operable to measure the relative angle of the housing to the base part. The sensor(s) operable to measure the relative angle of the housing to the base part may comprise an encoder or a potentiometer arranged to measure rotation about the pivot axis.

The drive unit may comprise at least one sensor operable to measure, directly or indirectly, longitudinal movement of each yoke shaft within its respective yoke shaft sleeve.

In embodiments comprising a mechanical mirror shaft configured to engage with the yoke shafts, the sensor(s) operable to measure, directly or indirectly, longitudinal movement of each yoke shaft within its respective yoke shaft sleeve may comprise an encoder or a potentiometer arranged to measure rotation about the longitudinal axis of the cross sleeve.

In some embodiments, the drive unit may comprise a drive means operable to move, in use, the drive unit along a running rail.

The drive means may comprise a motor, e.g. an electric motor.

The drive means may further comprise a gearbox coupled to the motor.

The drive means may comprise a drive wheel. The drive wheel may be a pinion configured to engage with a rack extending alongside the running rail.

The drive unit may comprise a sensor arranged to measure and/or monitor operation of the drive means, or, typically, of the motor. The sensor arranged to measure and/or monitor operation of the drive means may comprise an encoder or a potentiometer arranged to measure rotations of the motor.

A second aspect of the invention provides a rail-guided displacement device, e.g. a stair lift, comprising a drive unit according to the first aspect of the invention and a support platform attached to the base part of the drive unit.

The support platform may for example comprise a chair or a seat.

In some embodiments, the displacement device may comprise an inclinometer coupled to the support platform.

A third aspect of the invention provides a rail-guided displacement device system, e.g. a stair lift system, comprising:

- a running rail;
- a rail-guided displacement device according to the second aspect of the invention on the running rail; and
- a control system operable to control travel of the rail-guided displacement device along the running rail.

The rail-guided displacement device system may comprise a single running rail.

The running rail may be configured at an end to provide a first step start.

The control system may control travel of the rail-guided displacement device in response to signals received from one or more sensors, e.g. encoders or potentiometers, in or on the drive unit.

The control system may comprise a level control system operable to hold the support platform level as the rail-guided displacement device moves along the running rail.

The control system may be operable to vary the speed of the rail-guided displacement device as it moves along the running rail. For instance, the control system may operate to reduce the speed of the rail-guided displacement device as it approaches and/or travels around a bend in the running rail.

A fourth aspect of the invention provides a method of installing a rail-guided displacement device system at an intended site of use, the method comprising:

- mounting a drive unit according to the first aspect of the invention on a running rail; and
- installing a control system operable to control travel of the rail-guided displacement device along the running rail.

The method may include the step of fixing the running rail in place at the intended site of use.

The intended site of use may comprise at least one staircase.

The method may further comprise the step of attaching a support platform to the base part of the drive unit, e.g. to provide a rail-guided displacement device according to the second aspect of the invention for mounting on the running rail.

BRIEF DESCRIPTION OF THE DRAWINGS

In order that the invention can be well understood, certain embodiments will be described by way of example only with reference to the accompanying drawings, in which.

DETAILED DESCRIPTION

Figure 1:
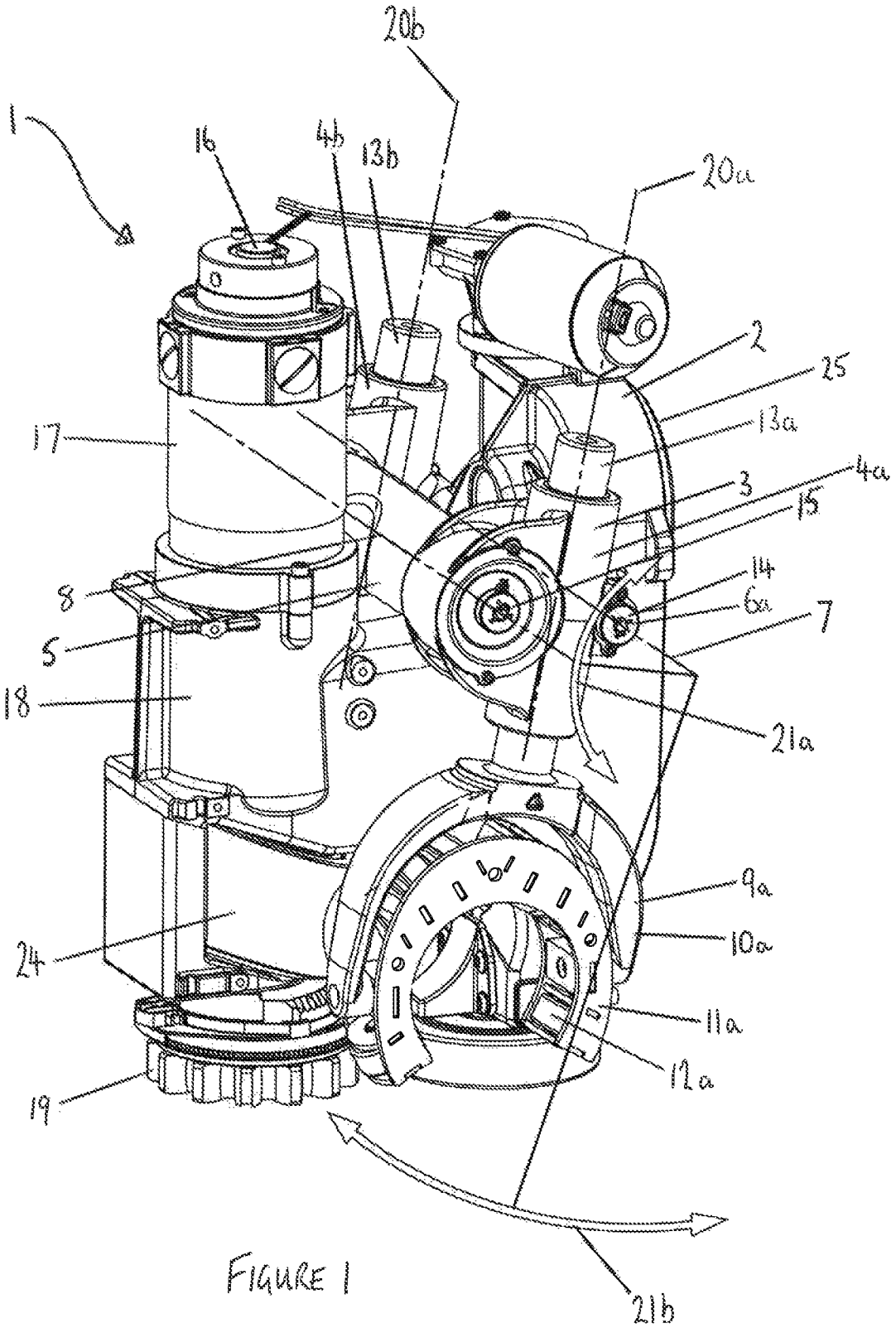
FIG. 1 shows an example embodiment of a drive unit for a stair lift according to the invention.
Figure 3:
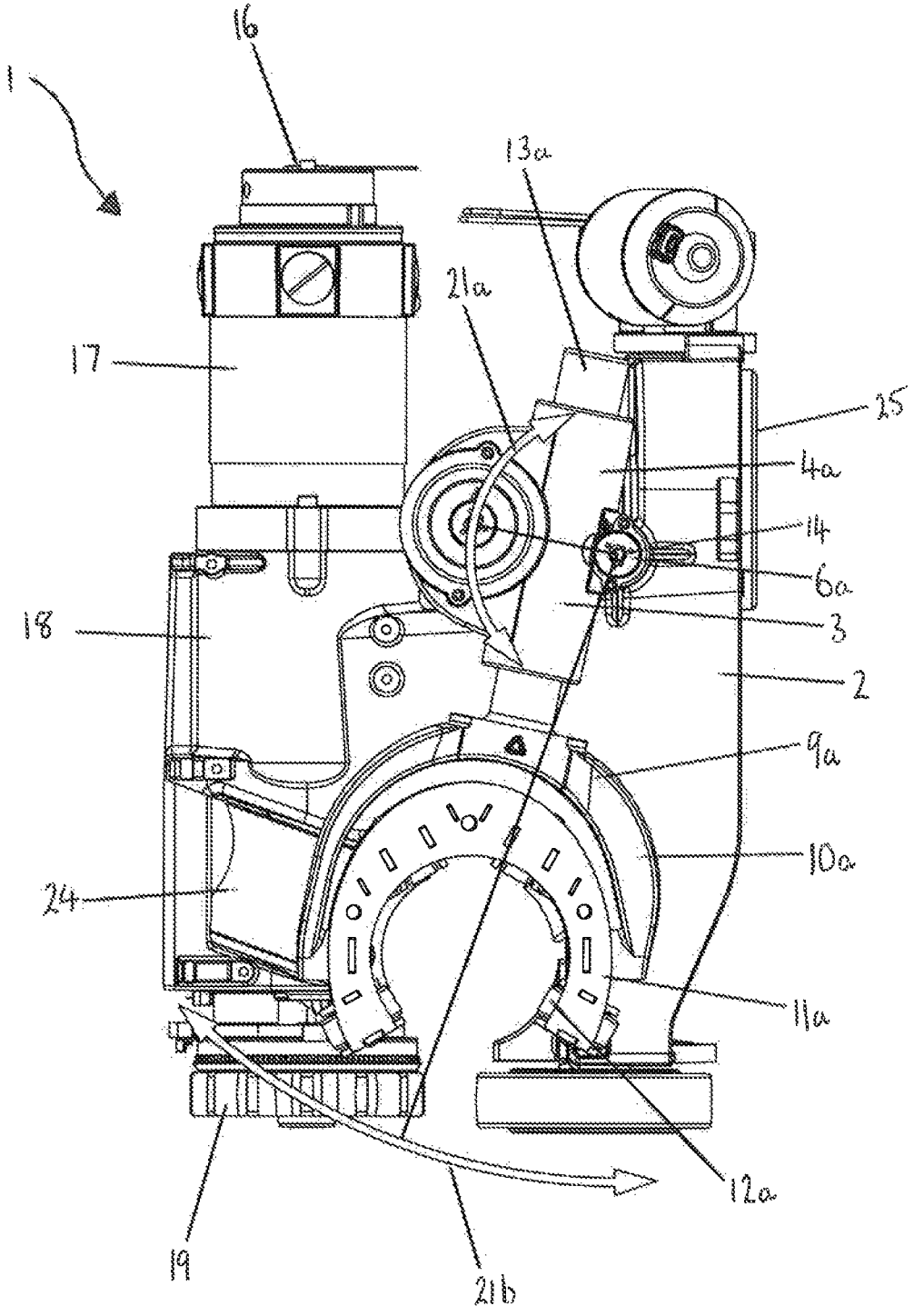
FIG. 3 is a side elevation of the drive unit of FIG. 1.

FIGS. 1 and 3 show a drive unit 1 according to an example embodiment of the invention. The drive unit 1 is adapted for use with a single running rail (not shown), typically of round cross-section, running alongside a staircase.

The drive unit 1 comprises a base part 2. The base part 2 has a rear portion and a front portion with an intermediate cross portion extending between the rear portion and the front portion. In the rear portion of the base part 2, there is a gear box housing 18 containing a gear box. The gear box is coupled to a motor 17, typically an electric motor. The motor is located above the gear box housing 18. Below the gear box, at the bottom of the base part 2 is a pinion 19. The pinion 19 is coupled to the gear box and hence the motor. The pinion 19 is configured to engage with a rack (not shown) arranged below the running rail. Together, the motor, gear box and pinion 19 provide a drive means operable to move, in use, the drive unit 1 along the running rail. Located between gear box housing 18 and the pinion 19 is a central guide wheel 24, configured to roll, in use, along the running rail. A sensor such as a motor encoder 16 is coupled to the motor and is operable to measure rotation of the motor. Alternatively, the sensor coupled to the motor and operable to measure rotation of the motor may comprise a potentiometer. A data link (not shown) is provided to carry data from the motor encoder 16 to a control system (not shown). A connector (not shown) is provided for connecting the motor to a power supply (not shown).

The front portion of the base part 2 is provided with means such as a socket 25 for securing a support surface or platform (not shown) such as a seat or chair to the drive unit 1. A means for maintaining the support surface in a horizontal orientation during travel may be provided. The means for maintaining the support surface in a horizontal orientation during travel may comprise an inclinometer.

The drive unit 1 further comprises a housing 3, which is pivotally connected to the base part 2. The parts of the housing 3 are shown particularly clearly in FIG. 2, as well as in FIGS. 1 and 3.

The housing 3 comprises a pair of elongate yoke shaft sleeves 4*a*, 4*b*, disposed on opposite sides of the base part 2. The elongate yoke shaft sleeves 4*a*, 4*b* have parallel longitudinal axes. A cross sleeve 5 rigidly connects the elongate yoke shaft sleeves 4*a*, 4*b* to each other. The cross sleeve 5 extends perpendicularly to the longitudinal axes of the yoke shaft sleeves 4*a*, 4*b*. The cross sleeve 5 passes over the intermediate cross portion and between the rear portion and the front portion of the base part 2.

The housing 3 is pivotally connected to the base part 2 at a pair of pivot points 6*a*, 6*b*, located on opposite sides of the base part 2. In use, the housing 3 pivots relative to the base part 2 about a pivot axis 7, which passes through pivot points 6*a*, 6*b*. A pivot encoder 14 is provided to measure rotation about the pivot axis 7. A data link (not shown) is provided to carry data from the pivot encoder 14 to a control system (not shown). It will be appreciated that the pivot encoder 14 is an example of a sensor that could be employed to measure rotation about the pivot axis 7. An alternative sensor could comprise a potentiometer.

The cross sleeve 5 contains a mechanical mirror shaft (not shown), which has at each end a gear 23*a*. A mechanical mirror shaft encoder 15 is provided to measure rotation of the mechanical mirror shaft about a longitudinal axis 8 of the cross sleeve 5. A data link (not shown) is provided to carry data from the mechanical mirror shaft encoder 15 to a control system (not shown). It will be appreciated that the mechanical mirror shaft encoder 15 is an example of a sensor that could be employed to measure rotation of the mechanical mirror shaft about a longitudinal axis 8 of the cross sleeve 5. An alternative sensor could comprise a potentiometer.

Each yoke shaft sleeve 4*a*, 4*b* is adapted to receive a yoke shaft 13*a*, 13*b* of a yoke 9*a*, 9*b*.

Each yoke 9*a*, 9*b* comprises an open jaw portion 10*a*, 10*b*, in which is pivotally mounted a guide wheel assembly 11*a*, 11*b* comprising a plurality of yoke guide wheels 12*a*, 12*b*. The yoke guide wheels 12*a*, 12*b* are arranged to roll, in use, along the running rail. Each guide wheel assembly 11*a*, 11*b* is pivotally mounted in its respective open jaw portion 10*a*, 10*b* such that, in use, the guide wheel assembly 11*a*, 11*b* will remain perpendicular to the running rail.

The drive unit 1 is configured such that the running rail (not shown) passes, in use, through the open jaw portions 10*a*, 10*b* of the yokes 9*a*, 9*b* disposed on opposite sides of the base part 2 and beneath the cross portion of the base part 2. Thus, the yoke guide wheels 12*a*, 12*b* and the central guide wheel 24, which is located between the yokes 9*a*, 9*b*, run along the running rail, in use.

The yoke shaft 13*a*, 13*b* of each yoke 9*a*, 9*b* extends away from the open jaw portion 10*a*, 10*b* and passes through the yoke shaft sleeve 4*a*, 4*b*. Each yoke shaft 13*a*, 13*b* is movable, in use, longitudinally within the yoke shaft sleeve 4*a*, 4*b*, in which the yoke shaft sleeve 13*a*, 13*b* is received. Central longitudinal axes 20*a*, 20*b* of the yoke shafts 13*a*, 13*b* are indicated in the drawings. The yoke shafts 13*a*, 13*b* can move longitudinally within the yoke shaft sleeves 4*a*, 4*b*.

Figure 2:
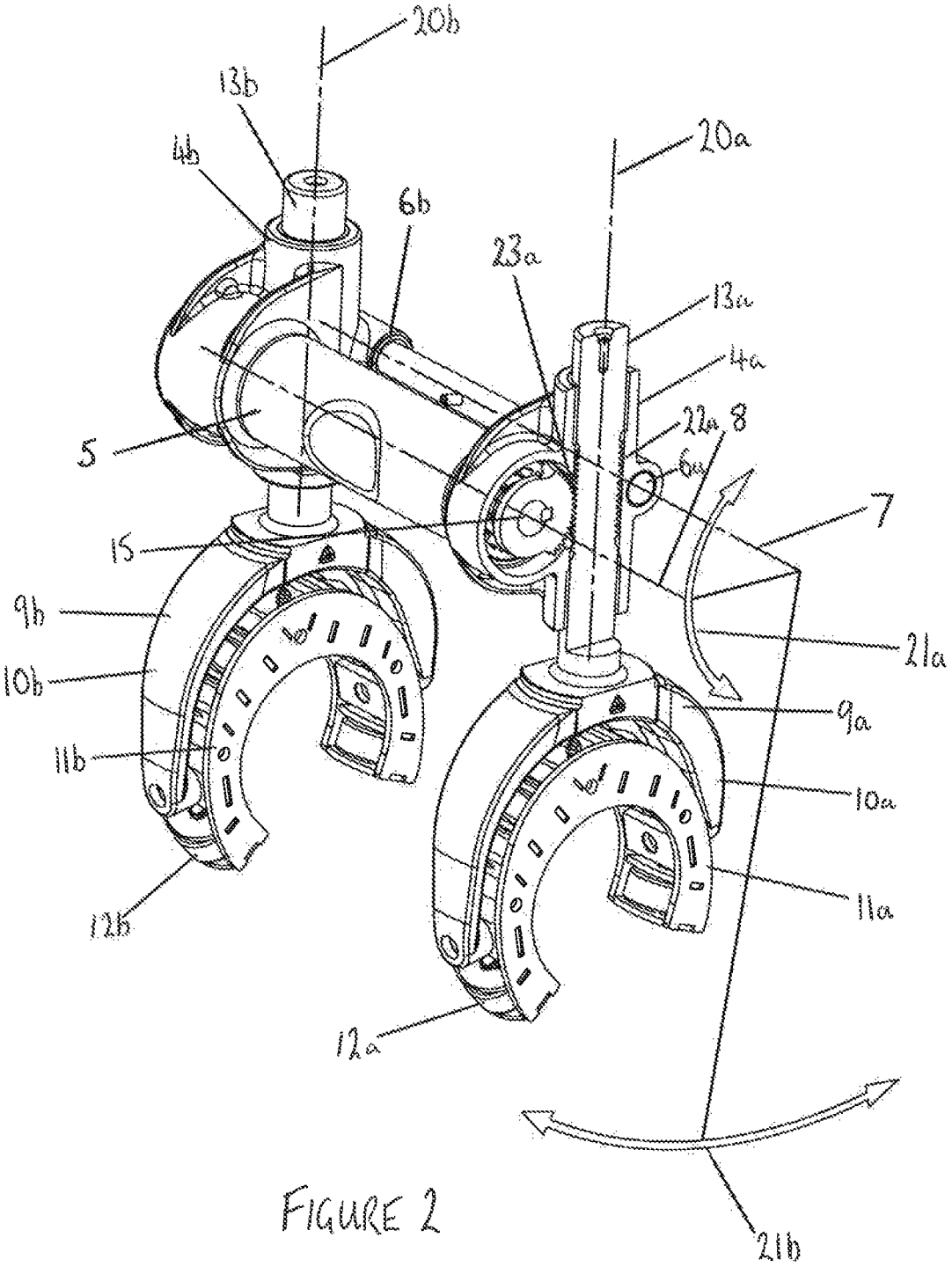
FIG. 2 shows in more detail and partially cut away, the housing and yokes of the drive unit shown in FIG. 1.

As shown in FIG. 2, the yoke shaft 13*a* has a toothed portion 22*a* located in an intermediate region of the yoke shaft 13*a*. The toothed portion 22*a* engages with the gear 23*a* at the end of the mechanical mirror shaft. The other yoke shaft 13*b* also has a toothed portion (not shown) located in an intermediate region of the yoke shaft 13*b*. The toothed portion engages with a gear (not shown) at the respective end of the mechanical mirror shaft.

The engagement between toothed portions on the yoke shafts 13*a*, 13*b* and the gears on the mechanical mirror shaft mean that the mechanical mirror shaft rotates as the yoke shafts 13*a*, 13*b* move longitudinally in their respective yoke shaft sleeves 4*a*, 4*b*. The rotation of the mechanical mirror shaft is measured, in use, by the mechanical mirror shaft encoder 15. From this measurement, the position of the yoke shafts 13*a*, 13*b* in their respective yoke shaft sleeves 4*a*, 4*b* can be inferred. The mechanical mirror shaft acts to ensure that when one yoke shaft moves, the other yoke shaft also moves.

As can be seen in FIG. 1, the pivot axis 7 is offset from the longitudinal axis 8 of the cross sleeve 5. Such an offset is not required for proper functioning of the drive unit 1, i.e. the pivot axis 7 and the longitudinal axis 8 of the cross sleeve 5 may not be offset from each other. The central longitudinal axes 20*a*, 20*b* of the yoke shafts 13*a*, 13*b* are parallel with each other and extend perpendicularly to a plane containing the pivot axis 7 and the longitudinal axis 8 of the cross sleeve 5. The central longitudinal axes 20*a*, 20*b* of the yoke shafts 13*a*, 13*b* intersect the plane containing the pivot axis 7 and the longitudinal axis 8 of the cross sleeve 5 between the pivot axis 7 and the longitudinal axis 8 of the cross sleeve 5.

By pivoting about the pivot axis 7, in use, the housing 3 moves through a housing swing arc 21*a*. As a consequence, the yokes 9*a*, 9*b*, move, in use, through a yoke swing arc 21*b*.

The combination of a swing motion and longitudinal movement of the connected yoke shafts enables the drive unit to traverse, in use, a running rail having any combination of types of bend.

Figure 4:
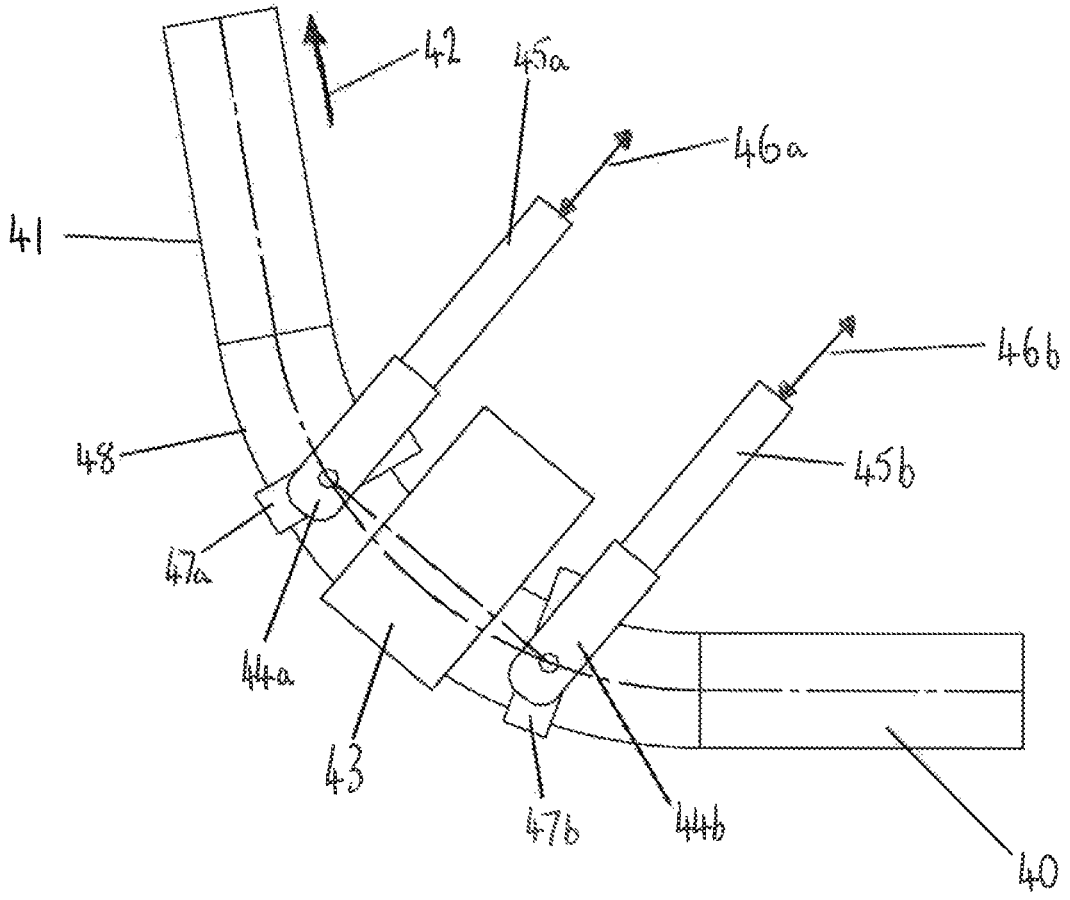
FIG. 4 illustrates schematically a drive unit according to the invention traversing a climbing bend.

FIG. 4 shows schematically a side view of a drive unit according to the invention traversing a climbing bend 48 in a running rail. The climbing bend 48 is between a horizontal section 40 of the running rail and a sloping section 41 of the running rail.

The drive unit is travelling in the direction indicated by the arrow 42. Shown schematically is a base part 43 of a drive unit between a leading yoke 44*a* with a yoke shaft 45*a* and a following yoke 44*b* with a yoke shaft 45*b*. Longitudinal movement of the yoke shafts 45*a*, 45*b* within the yoke shaft sleeves is indicated by the double headed arrows 46*a*, 46*b*. Each yoke 44*a*, 44*b* has a guide wheel assembly 47*a*, 47*b* pivotally connected thereto. As can be seen in FIG. 4, the guide wheel assemblies 47*a*, 47*b* pivot relative to their respective yokes 44*a*, 44*b* such that the guide wheel assemblies 47*a*, 47*b* remain perpendicular to the running rail as the drive unit traverses the climbing bend 48.

Figure 5:
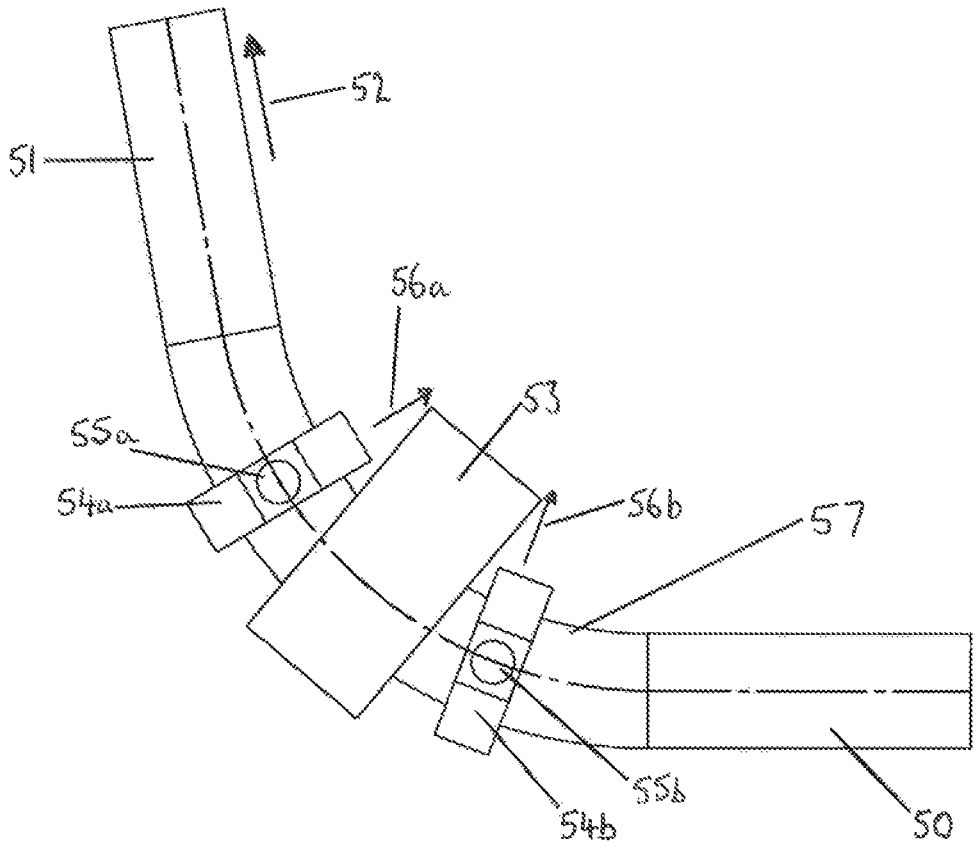
FIG. 5 illustrates schematically a drive unit according to the invention traversing a flat bend.

FIG. 5 shows schematically a plan view of a drive unit according to the invention traversing a flat bend 57 in a running rail. The flat bend 57 is between a first section 50 of the running rail and a second section 51 of the running rail, the second section 51 of the running rail extending in a different direction from the first section 50 of the running rail. The drive unit is travelling in the direction indicated by the arrow 52. Shown schematically is a base part 53 of a drive unit between a leading yoke 54*a* with a yoke shaft 55*a* and a following yoke 54*b* with a yoke shaft 55*b*. Swing movement of the yoke shafts 55*a*, 55*b* is indicated by the arrows 56*a*, 56*b*.

A stair lift system may comprise a drive unit according to the present invention. In such a stair lift system, the drive unit may be coupled to a support platform such as a seat or a chair. The stair lift system may comprise a running rail. The stair lift system may comprise a control system in communication with the drive unit and operable to control movement of the drive unit along the running rail. In particular, one or more sensors (e.g. encoders or potentiometers) on the drive unit may be in communication with the control system.

Conveniently, the drive unit of the present invention can be used with a running rail that is configured for a first step start. In a first step start configuration, the running rail typically comprises a vertical section adjacent a first step of a staircase. Having a running rail that is configured for a first step start may be particularly beneficial in stair lift systems installed on staircases in relatively confined spaces.

An example of the operation of the drive unit 1, or a stair lift system comprising the drive unit 1, will now be described.

The yoke guide wheels 12*a*, 12*b* of the guide wheel assemblies 11*a*, 11*b* mounted in the yokes 9*a*, 9*b* provide a connection with the running rail either side of the base part 2 of the drive unit 1. As described above, the yokes 9*a*, 9*b* are connected together via the toothed portions of yoke shafts 13*a*, 13*b* engaging with the gears on the mechanical mirror shaft. Accordingly, a mechanical mirror is formed, which causes, in use, both yokes 9*a*, 9*b* to move together when the drive unit enters a climbing bend (or a bend comprising a climbing component).

In the climbing bend, the angle of rotation of the mechanical mirror shaft inside the cross sleeve 5 is dependent upon the rate of change of the gradient of the running rail. This gradient is inferred from readings taken by the mechanical mirror shaft encoder 15. Consequently, the control system is provided with the instantaneous rate of change of the gradient of the running rail.

As described above, the housing 3 is pivotally connected to the base part 2, which allows the drive unit 1 to negotiate flat bends (or bends comprising a flat bend component). In a flat bend, the swing angle between the housing 3 and the base part 2 is dependent upon the rate of change of direction (horizontal angle) of the running rail. The pivot encoder 14 measures the angle of the housing 3 relative to the base part 2. Consequently, the control system is provided with the instantaneous rate of change of the direction (horizontal angle) of the running rail.

In addition, the motor encoder 16 is operable to provide the control system with measurements of the rotation of the motor, from which the distance travelled along the running rail can be inferred.

A support platform such as a seat or chair typically may be coupled to the drive unit. In use, the support platform may be kept in a substantially horizontal orientation. For instance, a chair may be attached to the drive unit on a horizontal axis of rotation.

Means to tilt the chair about the horizontal axis, in use, may be provided to tilt the chair such that the chair remains substantially horizontal to the ground as the gradient of the running rail changes.

An inclinometer may be coupled to the chair and may be in communication with the control system. Accordingly, the control system may use data received from the inclinometer to determine, in use, the angle of the chair to the horizontal.

In some embodiments, the stair lift system may comprise a level control system operable to hold the support platform, e.g. seat or chair, horizontal as the drive unit moves along the rail and the gradient of the rail changes with respect to the horizontal.

For instance, the level control system may be configured to integrate the output of the mechanical mirror shaft encoder 15. The integrated value may then provide a demand proportional to the angular rotation of the support platform, e.g. seat or chair, about the horizontal axis required to maintain the support platform in a substantially horizontal position.

In embodiments comprising an inclinometer, the output of the inclinometer may be used to recalibrate the stair lift system against long-term drift. The inclinometer may be monitored by the control system during operation. The control system may be configured to shut down the stair lift system and/or issue an alarm or warning message in the event that the inclinometer detects that the support platform, e.g. seat or chair, is no longer level (i.e. in a substantially horizontal position).

By receiving data from the mechanical mirror shaft encoder 15, the pivot encoder 14 and, optionally, the motor encoder 16, the control system may determine in real-time where on the running rail the drive unit 1 is located. Accordingly, there may be no need to pre-program and/or memory map the drive unit and control system for a given running rail when installing a stair lift system according to the invention.

The control system may be operable to establish the positions of the ends of the running rail. The output of the sensors (e.g. comprising encoders or potentiometers) measuring the angle of the housing relative to the base part and the rotation of the mechanical mirror shaft may be monitored by the control system to determine in real-time the position of bends in the running rail. In response, the control system may be operable to vary the speed of travel of the drive unit as it travels along the running rail, e.g. to implement a speed decrease as the drive unit enters a bend and/or to implement a speed increase as the drive unit exits a bend.

A number of modifications and variations will be apparent to the skilled person, and the foregoing examples are not intended to limit the invention, which should be determined with reference to the appended claims.

The invention claimed is:

1. A drive unit for a rail-guided displacement device comprising:

a base part;

a housing comprising:

a first yoke shaft sleeve and a second yoke shaft sleeve, the first yoke shaft sleeve and the second yoke shaft sleeve being spaced apart and disposed on opposite sides of the base part, and a cross sleeve rigidly connecting the first yoke shaft sleeve and the second yoke shaft sleeve; wherein the housing is pivotally connected to the base part such that the housing can pivot, in use, relative to the base part about a pivot axis;

a first yoke and a second yoke, each of the first yoke and the second yoke comprising:

a guide wheel assembly, the guide wheel assembly comprising one or more guide wheels arranged to roll, in use, along a running rail; and a yoke shaft;

wherein the yoke shaft of the first yoke is received in the first yoke sleeve and the yoke shaft of the second yoke is received in the second yoke sleeve, the yoke shafts being movable longitudinally within their respective yoke sleeve, in use; and a communication means disposed at least partially within the cross sleeve, the communication means providing communication between the yoke shafts in the yoke sleeves and being configured such that when, in use, one of the yoke shafts moves longitudinally in its yoke sleeve the communication means causes the other of the yoke shafts correspondingly to move longitudinally in its yoke sleeve.

2. The drive unit according to claim 1, wherein the communication means comprises a mechanical mirror shaft configured to engage with the yoke shafts.

3. The drive unit according to claim 1, wherein the pivot axis is offset from the longitudinal axis of the cross sleeve.

4. The drive unit according to claim 1, wherein central longitudinal axes of the yoke shafts are parallel with each other and extend substantially perpendicularly to a plane containing the pivot axis and the longitudinal axis of the cross sleeve.

5. The drive unit according to claim 1, wherein each guide wheel assembly is pivotable relative to its respective yoke.

6. The drive unit according to claim 1, wherein each yoke comprises an open jaw having the guide wheel assembly mounted therein.

7. The drive unit according to claim 1 comprising at least one sensor operable to measure the relative angle of the housing to the base part.

8. The drive unit according to claim 1 comprising at least one sensor operable to measure, directly or indirectly, longitudinal movement of each yoke shaft within its respective yoke shaft sleeve.

9. The drive unit according to claim 1 comprising a drive means operable to move, in use, the drive unit along a running rail.

10. A rail-guided displacement device comprising a drive unit according to claim 1 and a support platform attached to the base part of the drive unit.

11. The rail-guided displacement device according to claim 10 comprising an inclinometer coupled to the support platform.

12. A rail-guided displacement device system comprising:

a running rail;

a rail-guided displacement device according to claim 10 on the running rail; and a control system operable to control travel of the rail-guided displacement device along the running rail.

13. The rail-guided displacement device system according to claim 12 comprising a single running rail.

14. The rail-guided displacement device system according to claim 12, wherein the rail-guided displacement device system is a stair lift system.

15. The rail-guided displacement device system according to claim 12, wherein the control system controls travel of the rail-guided displacement device in response to signals received from one or more sensors in or on the drive unit.

16. The rail-guided displacement device system according to claim 12, wherein the control system comprises a level control system operable to hold the support platform level as the rail-guided displacement device moves along the running rail.

17. The rail-guided displacement device system according to claim 12, wherein the control system is operable to vary the speed of the rail-guided displacement device as the rail-guided displacement device moves along the running rail.

18. A method of installing a rail-guided displacement device system at an intended site of use, the method comprising:

mounting a drive unit according to claim 1 on a running rail; and installing a control system operable to control travel of the rail-guided displacement device along the running rail.

19. The method according to claim 18 including the step of fixing the running rail in place at the intended site of use.

20. The method according to claim 18, further comprising the step of attaching a support platform to the base part of the drive unit.

21. The method according to claim 2, wherein the mechanical mirror shaft engages with the yoke shafts such that longitudinal movement of the yoke shafts within the yoke shaft sleeves causes rotational movement of the mechanical mirror shaft.

22. The method according to claim 4, wherein the central longitudinal axes of the yoke shafts intersect a plane containing the pivot axis and the longitudinal axis of the cross sleeve.

23. The method according to claim 9, further comprising a sensor arranged to measure and/or monitor operation of the drive means.

24. The method according to claim 10, wherein the support platform comprises a chair or a seat.

25. The method according to claim 14, wherein the running rail is configured at an end to provide a first step start.

26. The method according to claim 19, wherein the intended site of use comprises at least one staircase.

* * * * *